US007316552B2

(12) United States Patent
Haynes et al.

(10) Patent No.: US 7,316,552 B2
(45) Date of Patent: Jan. 8, 2008

(54) LOW TURBULENCE DIE ASSEMBLY FOR MELTBLOWING APPARATUS

(75) Inventors: Bryan D. Haynes, Advance, NC (US); Michael C. Cook, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 279 days.

(21) Appl. No.: 11/022,381

(22) Filed: Dec. 23, 2004

(65) Prior Publication Data

US 2006/0141086 A1 Jun. 29, 2006

(51) Int. Cl.
*B28B 5/00* (2006.01)

(52) U.S. Cl. ..... 425/72.2; 425/72.1; 425/7

(58) Field of Classification Search ..... 425/72.1, 425/72.2, 7

See application file for complete search history.

(56) References Cited

U.S. PATENT DOCUMENTS

| | | | | |
|---|---|---|---|---|
| 3,825,379 | A | 7/1974 | Lohkamp et al. | |
| 3,825,380 | A | 7/1974 | Harding et al. | |
| 3,865,535 | A | 2/1975 | Langdon et al. | |
| 3,936,262 | A | 2/1976 | Hehl | |
| 4,295,809 | A | 10/1981 | Mikami et al. | |
| 4,380,570 | A | 4/1983 | Schwarz | |
| 4,526,733 | A | 7/1985 | Lau | |
| 4,720,252 | A | 1/1988 | Appel et al. | |
| 4,826,415 | A | 5/1989 | Mende | |
| 4,889,476 | A | 12/1989 | Buehning | |
| 4,986,743 | A | 1/1991 | Buehning | |
| 5,080,569 | A | 1/1992 | Gubernick et al. | |
| 5,087,186 | A | 2/1992 | Buehning | |
| 5,098,636 | A | 3/1992 | Balk | |
| 5,145,689 | A | 9/1992 | Allen et al. | |
| 5,160,746 | A * | 11/1992 | Dodge et al. | 425/7 |
| 5,196,207 | A | 3/1993 | Koenig | |
| 5,236,641 | A | 8/1993 | Allen et al. | |
| 5,248,247 | A | 9/1993 | Rübhausen et al. | |
| 5,269,670 | A | 12/1993 | Allen et al. | |
| 5,344,297 | A | 9/1994 | Hills | |

(Continued)

FOREIGN PATENT DOCUMENTS

| | | |
|---|---|---|
| EP | 0474421 A2 | 3/1992 |

(Continued)

OTHER PUBLICATIONS

Search Report, Mar. 2, 2006.

*Primary Examiner*—Yogendra Gupta
*Assistant Examiner*—Maria Veronica Ewald
(74) *Attorney, Agent, or Firm*—Dority & Manning

(57) ABSTRACT

An apparatus for forming meltblown material from a molten polymer includes a die configured with channels in the tip of the die through which molten polymer is extruded for forming meltblown fibers. Air plates are disposed relative to the die tip to define air channels proximate to the die tip for directing attenuating air against the molten polymer fibers extruded from the tip. The air channels include a zone of convergence adjacent the apex of the die tip at an included angle that is within a range of about 10 degrees to about 20 degrees such that each of the air channels defines a convergence angle with respect to a longitudinal axis of the polymer channels of between about 5 degrees to about 10 degrees.

16 Claims, 4 Drawing Sheets

U.S. PATENT DOCUMENTS

| | | | | |
|---|---|---|---|---|
| 5,421,921 | A | 6/1995 | Gill et al. | |
| 5,421,941 | A | 6/1995 | Allen et al. | |
| 5,423,935 | A | 6/1995 | Benecke et al. | |
| 5,445,509 | A | 8/1995 | Allen et al. | |
| 5,458,291 | A | 10/1995 | Brusko et al. | |
| 5,476,616 | A | 12/1995 | Schwarz | |
| 5,516,476 | A | 5/1996 | Haggard et al. | |
| 5,580,581 | A | 12/1996 | Buehning | |
| 5,595,699 | A | 1/1997 | Wright et al. | |
| 5,605,706 | A | 2/1997 | Allen et al. | |
| 5,605,720 | A | 2/1997 | Allen et al. | |
| 5,618,566 | A | 4/1997 | Allen et al. | |
| 5,632,938 | A | 5/1997 | Buehning, Sr. | |
| 5,679,042 | A | 10/1997 | Varona | |
| 5,679,379 | A | 10/1997 | Fabbricante et al. | |
| 5,725,812 | A | 3/1998 | Choi | |
| 5,728,219 | A | 3/1998 | Allen et al. | |
| 5,733,581 | A | 3/1998 | Barboza et al. | |
| 5,851,562 | A | 12/1998 | Haggard et al. | |
| 5,882,573 | A | 3/1999 | Kwok et al. | |
| 5,891,482 | A | 4/1999 | Choi | |
| 5,902,540 | A | 5/1999 | Kwok | |
| 5,904,298 | A | 5/1999 | Kwok et al. | |
| 5,976,427 | A | 11/1999 | Choi | |
| 6,074,597 | A | 6/2000 | Kwok et al. | |
| 6,182,732 | B1 | 2/2001 | Allen | |
| 6,183,670 | B1 | 2/2001 | Torobin et al. | |
| 6,200,120 | B1 | 3/2001 | Fish et al. | |
| 6,210,141 | B1 | 4/2001 | Allen | |
| 6,220,843 | B1 | 4/2001 | Allen | |
| 6,241,503 | B1 | 6/2001 | Wright et al. | |
| 6,296,463 | B1 | 10/2001 | Allen | |
| 6,315,806 | B1 | 11/2001 | Torobin et al. | |
| 6,336,801 | B1 | 1/2002 | Fish et al. | |
| 6,364,647 | B1 | 4/2002 | Sanborn | |
| 6,378,784 | B1 | 4/2002 | Allen et al. | |
| 6,422,428 | B1 | 7/2002 | Allen et al. | |
| 6,422,848 | B1 | 7/2002 | Allen et al. | |
| 6,427,745 | B1 | 8/2002 | Allen | |
| 6,491,507 | B1 | 12/2002 | Allen | |
| 6,502,615 | B1 | 1/2003 | Allen | |
| 6,540,831 | B1 | 4/2003 | Craine et al. | |
| 6,565,344 | B2 * | 5/2003 | Bentley et al. | 425/72.2 |
| 6,572,033 | B1 | 6/2003 | Pullagura et al. | |
| 6,596,205 | B1 | 7/2003 | Choi | |
| 2003/0173701 | A1 | 9/2003 | Arseneau et al. | |
| 2004/0009251 | A1 * | 1/2004 | Becker et al. | 425/72.2 |

FOREIGN PATENT DOCUMENTS

| | | | |
|---|---|---|---|
| EP | 0474422 | A2 | 3/1992 |
| EP | 0701010 | A1 | 3/1996 |
| EP | 0987352 | A2 | 3/2000 |
| EP | 0866152 | B1 | 11/2002 |
| EP | 1270770 | A2 | 1/2003 |
| EP | 0822053 | B1 | 6/2003 |
| JP | 54103466 | | 8/1979 |
| WO | 0100909 | | 1/2001 |
| WO | 0242043 | A1 | 5/2002 |
| WO | 2005 068692 | | 7/2005 |

* cited by examiner

LOW TURBULENCE DIE ASSEMBLY FOR MELTBLOWING APPARATUS

FIELD OF THE INVENTION

The present invention relates generally to the formation of fibers and nonwoven webs by a meltblowing process. More particularly, the present invention relates to an improved die assembly for use in a melt blowing process.

BACKGROUND OF THE INVENTION

The formation of fibers and nonwoven webs by meltblowing is well known in the art. See, by way of example, U.S. Pat. No. 3,016,599 to R. W. Perry, Jr.; U.S. Pat. No. 3,704,198 to J. S. Prentice; U.S. Pat. No. 3,755,527 to J. P. Keller et al.; U.S. Pat. No. 3,849,241 to R. R. Butin et al.; U.S. Pat. No. 3,978,185 to R. R. Butin et al.; U.S. Pat. No. 4,100,324 to R. A. Anderson et al.; U.S. Pat. No. 4,118,531 to E. R. Hauser; and U.S. Pat. No. 4,663,220 to T. J. Wisneski et al.

Briefly, meltblowing is a process type developed for the formation of fibers and nonwoven webs; the fibers are formed by extruding a molten thermoplastic polymeric material, or polymer, through a plurality of small holes. The resulting molten threads or filaments pass into converging high velocity gas streams that attenuate or draw the filaments of molten polymer to reduce their diameters. Thereafter, the meltblown fibers are carried by the high velocity gas stream and deposited on a collecting surface, or forming wire, to form a nonwoven web of randomly dispersed meltblown fibers.

Generally, meltblowing utilizes a specialized apparatus to form the meltblown webs from a polymer. Often, the polymer flows from a die through narrow cylindrical outlets and forms meltblown fibers. The narrow cylindrical outlets may be arrayed in a substantially straight line and lie in a plane which is the bisector of a V-shaped die tip. Typically the included angle formed by the exterior walls or faces of the V-shaped die tip is 60 degrees and is positioned proximate to a pair of air plates, thereby forming two slotted channels therebetween along each face of the die tip. Thus, air may flow through these channels to impinge on the fibers exiting from the die tip, thereby attenuating them. As a result of various fluid dynamic actions, the air flow is capable of attenuating the fibers to diameters of from about 0.1 to 10 micrometers; such fibers generally are referred to as microfibers. Larger diameter fibers, of course, also are possible depending on polymer viscosity and processing conditions, with the diameters ranging from around 10 micrometers to about 100 micrometers.

Investigation has been done in the art with respect to the effect of varying certain parameters of the attenuating air flows. For example, U.S. Pat. Nos. 6,074,597 and 5,902,540 disclose a meltblowing method and apparatus utilizing a die assembly formed from a stack of laminated plates having aligned orifices that define an adhesive flow path flanked on each side by air flows. The adhesive flow is drawn and attenuated by the air flows. These patents allege that convergent air flows in the conventional V-shaped die assemblies are inefficient, and that the air flows should be nonconvergent with respect to the adhesive flow to maximize the shear component of the compressed air flows.

U.S. Pat. No. 6,336,801 discusses the advantages of using as a primary drawing medium attenuating air that is cooler than the temperature of the polymer within the die tip and exiting from the nozzle outlets. One advantage is that the fibers quench more rapidly and efficiently, resulting in a softer web and less likelihood of formation of undesirable shot. ("Shot" is the accumulation of molten polymer at the die tip apex that eventually reaches a relatively large size and is blown from the die nose, not as a fiber, but as a blob or "shot.") Another advantage is that faster quenching may reduce the required forming distance between the die tip and the forming wire, thereby permitting the formation of webs with better properties, such as appearance, coverage, opacity, and strength. The '801 patent describes a novel die assembly that focuses heat at the die tip to maintain a desired polymer viscosity and thereby permitting use of significantly cooler attenuating air.

The art is continuously seeking ways to improve the meltblowing process to maximize efficiency and provide an improved meltblown web. The present invention relates to an improved die tip assembly for this purpose.

OBJECTS AND SUMMARY OF THE INVENTION

Objects and advantages of the invention will be set forth in part in the following description, or may be obvious from the description, or may be learned through practice of the invention.

An embodiment of the present invention is an apparatus for forming meltblown material. The apparatus includes a generally V-shaped die head body having a die tip forming a die tip apex. A channel is defined through the die tip and apex through which a molten polymer is expelled. Air plates are positioned at opposite sides of the die tip and define (with the die tip) air channels through which pressurized attenuating air is directed towards the die tip apex.

Applicants have found that a particularly beneficial meltblowing process is established by reducing the degree of convergence of the air channels in the known wedge or V-shaped type of die assemblies. Through careful observation and experimentation, the present inventors have determined that shot formation is also largely a result of a relatively high degree of turbulence generated by the diverging air streams in conventional die assemblies. It has generally been believed in the art that an included convergence angle for the attenuating air channels of about 60 degrees was necessary for proper drawing of the molten polymer extruded from the die tip apex, and this belief has gone generally unchallenged. Applicants have found that shot formation can be significantly reduced without adversely affecting the quality of meltblown fibers produced by decreasing the convergence angles of at least one, and preferably both of the air channels while maintaining a relatively high velocity profile of the attenuating air exiting the air channels. The velocity of the air is a function of a number of variables, including air pressure, channel dimensions and shape, and so forth, and for a given channel configuration, can be controlled by varying the pressure of the attenuating air supplied to the channels. The decreased angle of impact of the air streams with respect to the axis of the die tip results in significantly reduced air turbulence at the die tip apex, yet the velocity of the air streams is sufficient to draw the molten polymer into fine fibers.

In particular embodiments of die assemblies according to the invention, the included angle of convergence between the air channels is between about 10 degrees to about 20 degrees such that each air channel defines a convergence angle with respect to a longitudinal axis of the diet tip of between about 5 degrees to about 10 degrees. It is not necessary that each of the air channels have the same convergence angle with respect to the axis of the die tip. For example, one channel may have a convergence angle of 5 degrees and the other channel may have a convergence angle of 7 degrees. It may also be desired that only one of the air channels have a convergence angle that is less than 20 degrees.

In yet another embodiment, the air channels define a first zone of convergence at a first included angle, and a second zone of convergence adjacent to the die tip apex at a second included angle that is less than the first included angle. The second included angle may be within the range of between about 10 degrees to about 20 degrees. The first included angle may be greater than about 30 degrees, and more particularly about 60 degrees.

The air channels may have various configurations and cross-sectional shapes. In a particular embodiment, the air channels have a substantially constant cross-sectional area along the zone of convergence that is adjacent to the die tip apex, for example along the second zone of convergence in the embodiment having first and second zones of convergence. The air channels may have a varying cross-sectional area along the first zone of convergence.

The air channels may be defined with a step angular change between the first and second zones of convergence. Alternately, the channels may include a gradual angular change between the first and second zones of convergence.

The air channels may be defined by a space between the air plates and the sides of the die tip. In this embodiment, the die tip comprises side walls at a first angle along the first zone of convergence, and at a second angle along the second zone of convergence. Alternately, the side walls of the die tip may have a gradual or radial component defining the change in convergence of the air channels.

In the embodiment wherein a first convergence zone precedes the second convergence zone having a decreased convergence angle between the air channels, attenuating air may be supplied at a pressure greater than in conventional systems. For example, the air may be supplied at a pressure up to about 30 psig, as compared to 10 psig for many conventional systems. The air may be delivered at a relatively constant velocity, or at an increasing velocity profile as a result of convergence (i.e., reduction) of the cross-sectional profiles of the air channels in a direction towards the die tip apex.

The invention will be described in greater detail below with reference to particular embodiments illustrated in the figures.

DETAILED DESCRIPTION

Figure 1:
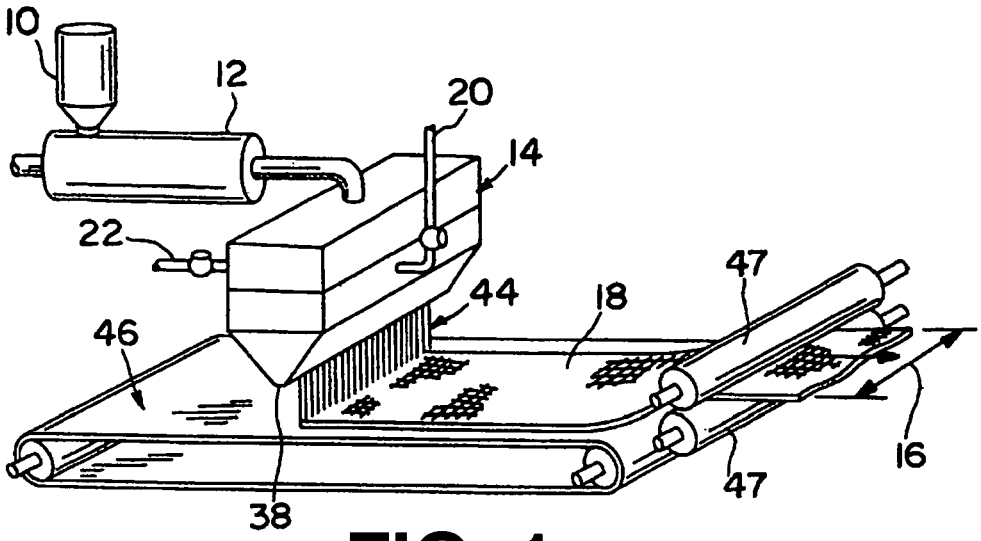
FIG. 1 Prior Art
FIG. 1 is an isometric view of a conventional meltblowing apparatus for making a nonwoven web.

Reference will now be made in detail to embodiments of the invention, one or more examples of which are illustrated in the drawings. Each example is provided by way of explanation of the invention, and not meant as a limitation of the invention. For example, features illustrated or described as part of one embodiment, may be used with another embodiment, to yield still a further embodiment. It is intended that the present invention include modifications and variations to the embodiments described herein.

Figure 2:
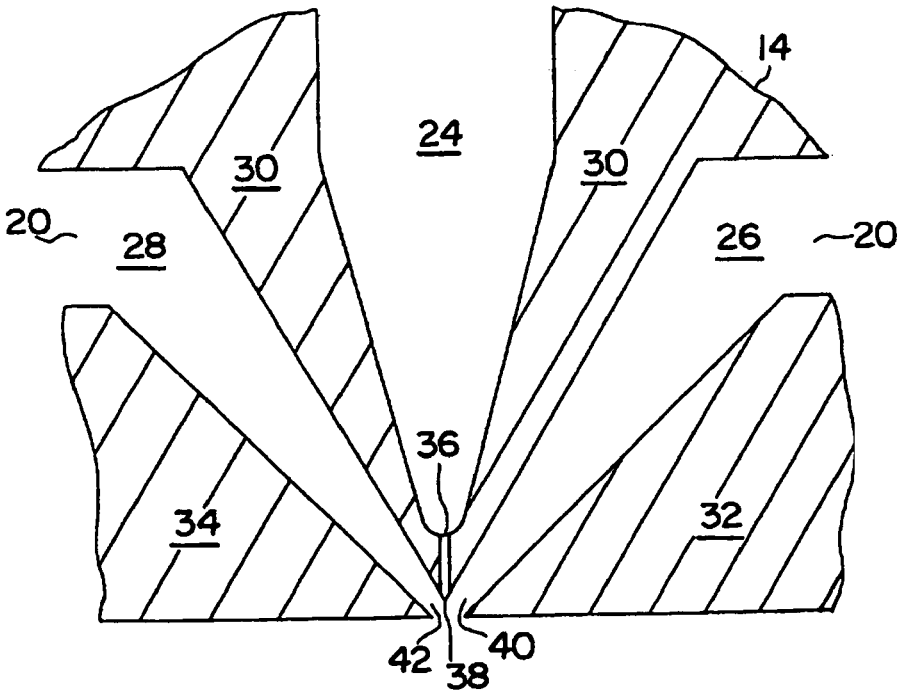
FIG. 2 Prior Art
FIG. 2 is a cross-sectional view of a die tip of a conventional die head.

A conventional apparatus and process for forming a meltblown fabric is shown in FIG. 1, and is instructive in an understanding of the present invention. Referring to FIG. 1, a hopper 10 provides polymer material to an extruder 12 attached to a die 14 that extends across the width 16 of a nonwoven web 18 to be formed by the meltblowing process. Inlets 20 and 22 provide pressurized gas to die 14. FIG. 2 shows a partial cross-section of a portion of die 14, including an extrusion slot 24 that receives polymer from extruder 12 and chambers 26 and 28 that receive pressurized gas from inlets 20 and 22. Chambers 26 and 28 are defined by base portion 30 and plates 32 and 34 of die 14.

The melted polymer is forced out of slot 24 through a plurality of small diameter capillaries 36 extending across tip 38 of die 14. The capillaries 36 generally have a diameter on the order of 0.0065 to 0.0180 in., and are spaced from 9-100 capillaries per inch. The gas passes from chambers 26 and 28 through passageways 40 and 42. The two streams of gas from passageways 40 and 42 converge to entrain and attenuate molten polymer threads 44 (see FIG. 1) as the polymer threads exit capillaries 36 and land on the forming surface 46, such as a belt. The molten material is extruded through capillaries 36 at a rate of from 0.02 to 1.7 grams/capillary/minute at a pressure of up to 300 psig. The temperature of the extruded molten material is dependent on the melting point of the material chosen, and is often in the range of 125 to 335 degree C. The attenuating air may be heated to 100 to 400 degree C. and, with conventional systems, is typically pressurized at about 10 psig.

The extruded threads 44 form a coherent, i.e. cohesive, fibrous nonwoven web 18 that may be removed by rollers 47, which may be designed to press web 18 together to improve the integrity of web 18. Thereafter, web 18 may be transported by conventional arrangement to a wind-up roll, pattern-embossed, etc. U.S. Pat. No. 4,663,220 discloses in greater detail an apparatus and process using the above-described elements, and is incorporated by reference herein.

Figure 3:
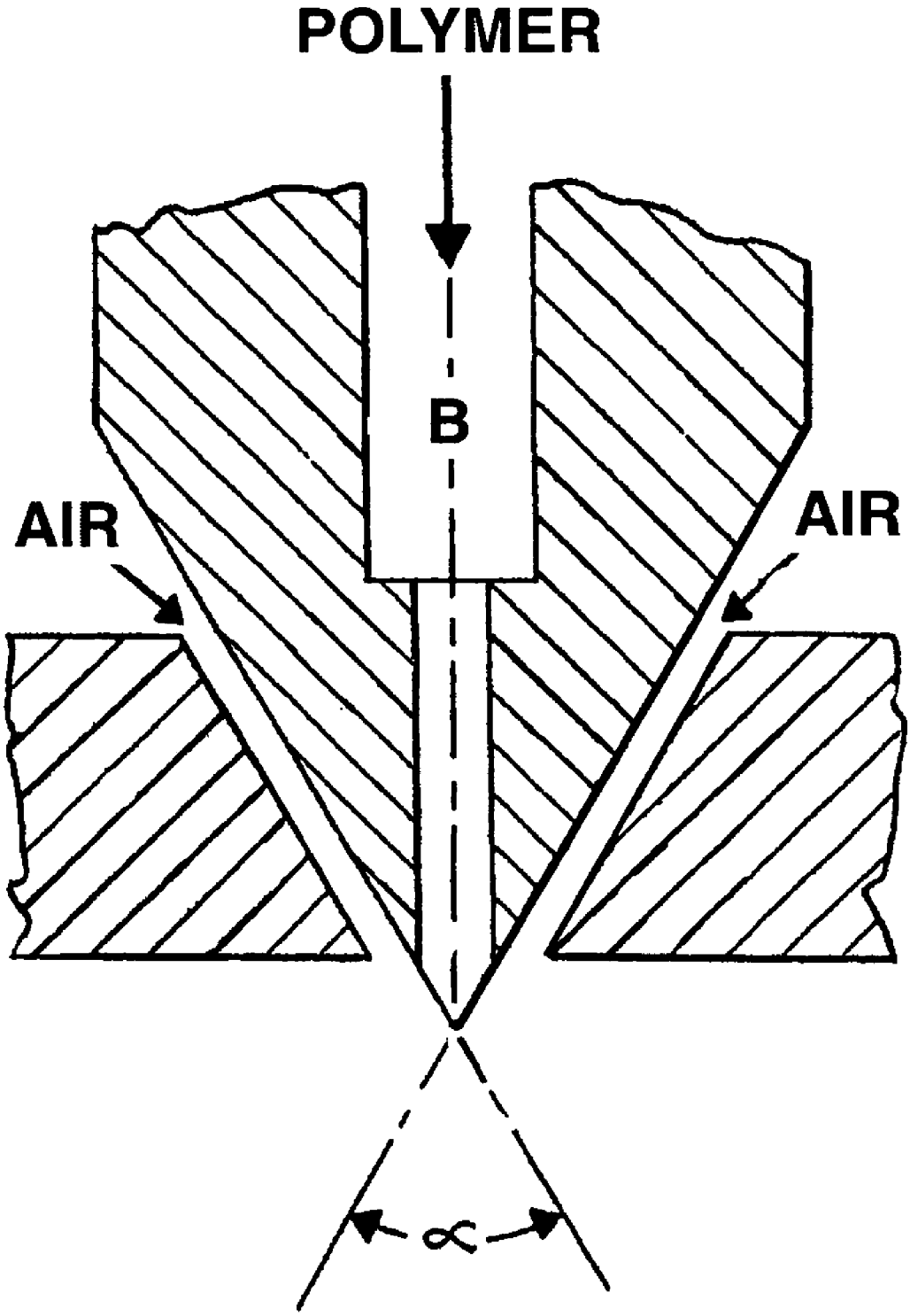
FIG. 3 Prior Art
FIG. 3 is a cross-sectional and diagrammatic view of conventional die tip.

FIG. 3 is a drawing substantially similar to FIG. 2 of U.S. Pat. No. 3,825,380 and depicts the generally accepted angular relationship of the converging air channels in conventional V-shaped die assemblies with respect to the axis B of the polymer channel C. This configuration is referred to generally in the art as an "Exxon" type of die assembly. The '380 patent describes that shot formation can be minimized by various factors, including proper die nose sharpness. In this regard, the '380 patent defines the convergence angle $\alpha$ as an included angle of at least 30 degrees, with 60 degrees being recommended as the best compromise between making shot and "rope."

Figure 4:
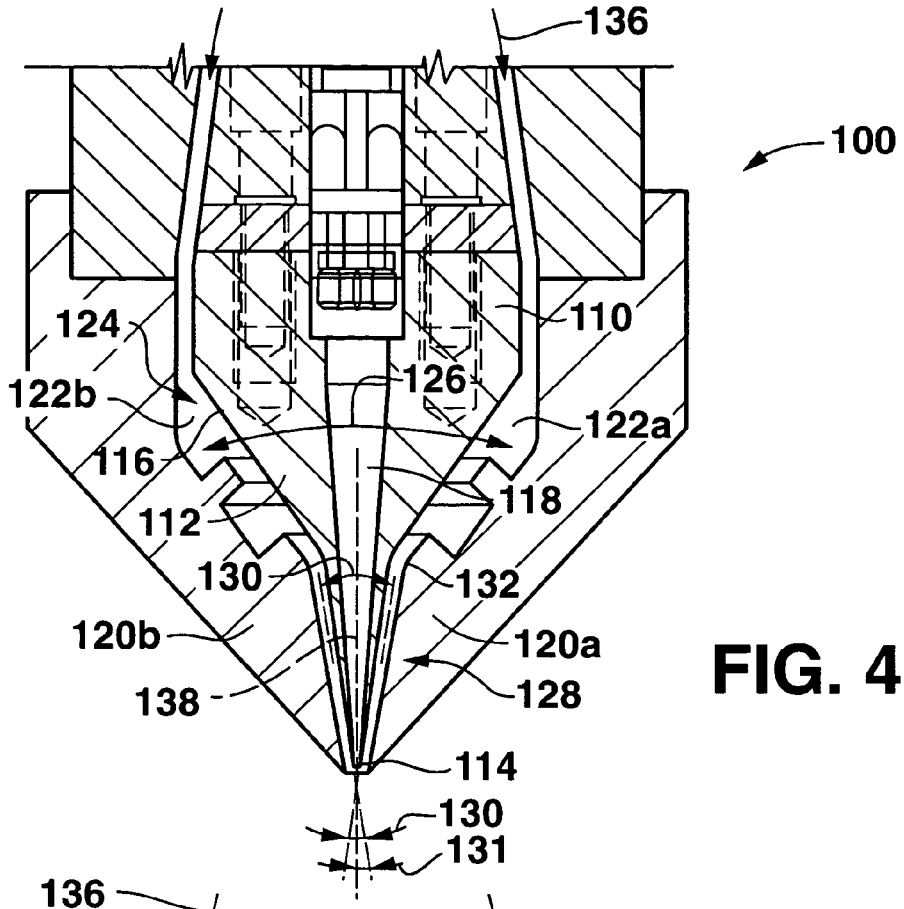
FIG. 4 is a cross-sectional view of an embodiment of a die head assembly according to the present invention.
Figure 5:
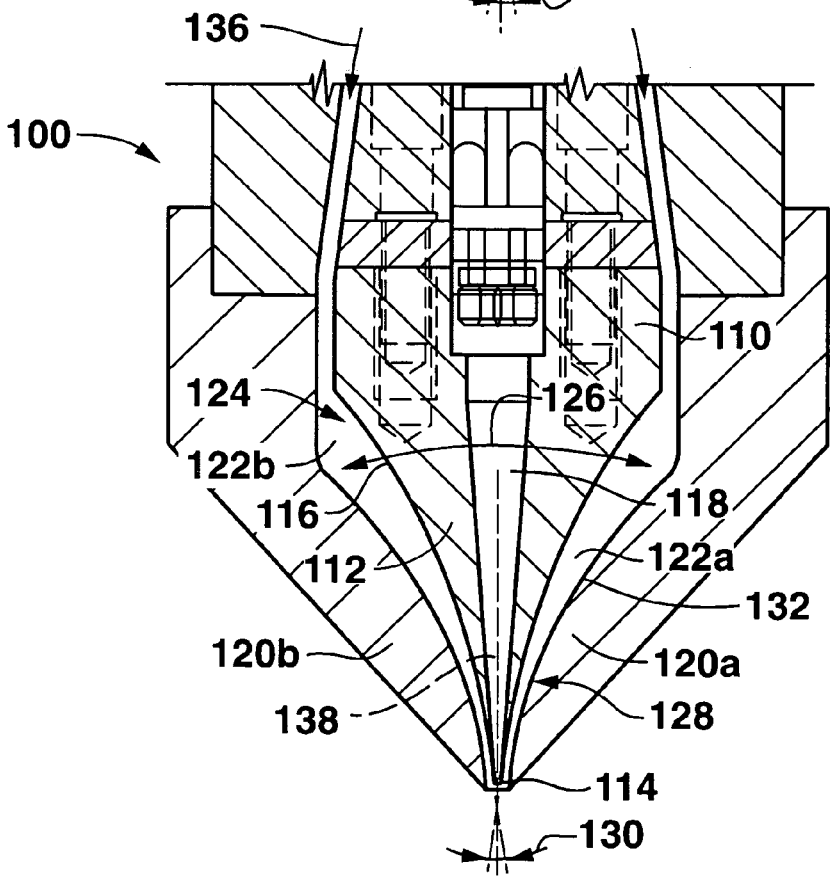
FIG. 5 is a cross-sectional view of an alternate embodiment of a die head assembly according to the invention.

Embodiments of an apparatus 100 according to the invention are shown in FIGS. 4 and 5. The apparatus 100 includes a die head 110 with a generally V-shaped die tip 112 defining a die tip apex 114. A polymer channel 118 is defined through the die tip 112 and has an exit orifice at the die tip apex 114. The polymer channel has a longitudinal axis 138.

It should be understood that FIGS. 4 and 5 are cross-sectional views through a single channel or "capillary" of the die tip. As is well known in the art, a typical die tip will have a plurality of the capillaries arranged substantially in a line or row across the length of the die tip, as in generally illustrated in FIG. 1.

It should also be understood that a die tip configuration according to the invention may contain additional or fewer components than are illustrated in the figures. For example, FIGS. 4 and 5 illustrate polymer breaker plates and a particular configuration of a polymer distribution cavity. These components are not essential to practice the invention, and may or may not be included in an apparatus 100 according to the invention.

Air plates 120*a* and 120*b* are disposed along opposite sides 116 of the die tip 112. The plates 120*a* and 120*b* cooperate with the die tip sides 116 to define air channels 122*a* and 122*b*. The air channels 122*a* and 122*b* direct pressurized attenuating air 136 at the die tip apex 114 to draw and attenuate the molten polymer extruded from the exit orifice of the polymer channel 118 into a relatively fine continuous fiber, as is well known to those skilled in the art.

Referring to FIG. 4, the air channels 122*a* and 122*b* have a zone of convergence (second zone 128) generally adjacent to the die tip apex 114 wherein the channels have an included convergence angle 130 of between about 10 degrees to about 20 degrees such that each air channel defines a convergence angle 131 with respect to the longitudinal axis 138 of the die tip 112 of between about 5 degrees to about 10 degrees.

As illustrated in FIG. 4, the air channels 122*a* and 122*b* may include a first zone of convergence 124 upstream of the second zone 128 wherein the air channels 122*a* and 122*b* have an included convergence angle 126 that is greater than the second included convergence angle 130. For example, the first included convergence angle 124 may be greater than 30 degrees, and in a particular embodiment may be 60 degrees.

The air channels 122*a* and 122*b* may have various configurations and cross-sectional shapes. For example, in the embodiment of FIG. 4, the air channels have a substantially constant cross-sectional area along the second zone of convergence 128 that is adjacent to the die tip apex 114. A constant cross-sectional area may be desired for precise control of the velocity of the attenuating air exiting the air channels. The air channels 122*a* and 122*b* may have a varying cross-sectional area along the first zone of convergence 124. Also, although the air channels 122*a* and 122*b* are illustrated as symmetrical with respect to the axis 138 of the die tip 112, it is within the scope and spirit of the invention that the channels be asymmetrical. For example, channel 122*a* may define a convergence angle of about 5 degrees with the axis 138, and channel 122*b* may define a converge angle of greater or less than 5 degrees with the axis 138.

As in the embodiment of FIG. 4, the air channels 122*a* and 122*b* may be defined with a well defined step angular change 132 between the first zone 124 and second zone 128 of convergence. The channels 122*a* and 122*b* may be generally straight on either side of the step angular change 132.

FIG. 5 shows an embodiment wherein the air channels 122*a* and 122*b* gradually change from the first zone 124 and second zone 128 of convergence. This gradual zone may be defined by, for example, a curved or radial dimension of the air plates 120*a* and 120*b* and/or the side walls 116 of the die tip 112.

The air channels 122*a* and 122*b* may be defined by a space between the air plates 120*a* and 120*b* and the sides 116 of the die tip 112, as illustrated in FIGS. 4 and 5. The side walls 116 may be defined at a first angle along the first zone of convergence 124, and at a second angle along the second zone of convergence 128. Alternately, the side walls 116 of the die tip 112 may have a gradual or radial component defining the change in convergence of the air channels, as in FIG. 5. The air channels 122*a* and 122*b* may, however, be defined in any suitable structure.

It should be appreciated that the pressure of the attenuating air supplied to the air channels 122*a* and 122*b* to achieve a desired velocity profile at the exit may vary as a function of a number of variables, including the shape and configuration of the air channels, angle of convergence of the air channels, viscosity of the molten polymer, and so forth. In the embodiment wherein a first convergence zone 124 precedes a second convergence zone 128 having a decreased convergence angle between the air channels 122*a* and 122*b*, attenuating air may be supplied within a pressure range of between about 2 psig and about 30 psig. In an embodiment, wherein the included angle of convergence 130 of the air channels along the second zone of convergence 128 is about 16 degrees, the pressure of the attenuating air supplied to the air channels may be about 20 psig.

EXAMPLE

A small scale prototype system of the embodiment depicted in FIG. 4 was used for the following example. The die tip was 4 inches in width measured across the span of the primary air slot formed by air plates 120*a* and 120*b*. There were thirty capillaries 114 drilled in the center of the die tip 110. Samples were collected and average fiber size was determined for various run conditions. The following table shows the average fiber size as a function of primary air pressure and polymer through put. For each condition the primary air pressure was increased until lint was observed. Exxon Mobil polypropylene with a MFR of 1300 was used for the example. The melt temperature was 423° F. and the primary air temperature was 500° F.

| Throughput (ghm) | Primary Air Pressure (psig) | Avg. Fiber Diameter (in microns) |
|---|---|---|
| 0.2 | 3.5 | 2.88 |
| 1.2 | 23 | 4.00 |
| 1.5 | 25 | 3.64 |

Figure 6:
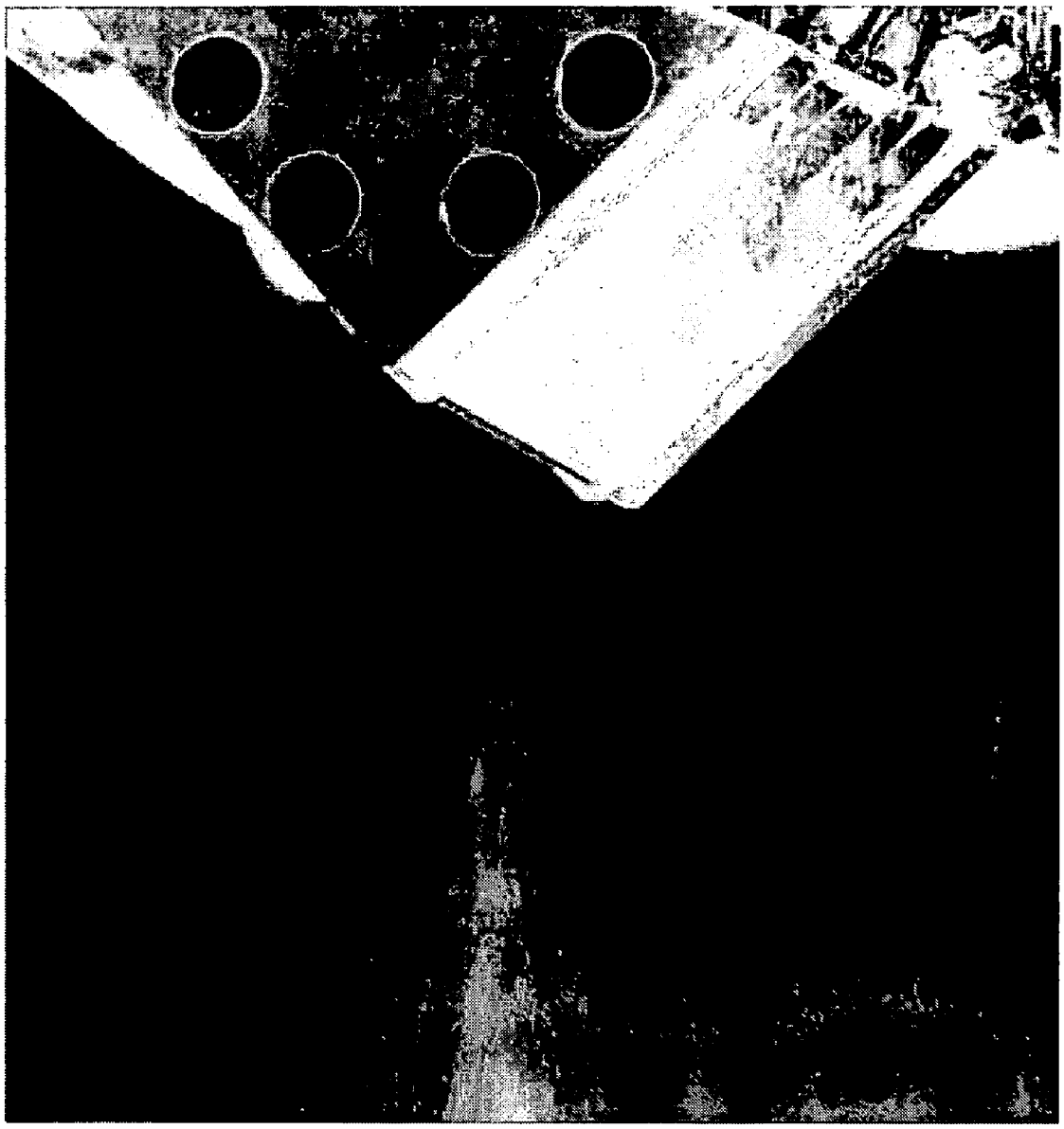
FIG. 6 is a photograph of a prototype system according to the invention in operation.

The design demonstrated the ability to process at high pressures and obtain fine fibers even at high polymer throughputs. A photograph of the system running is shown in FIG. 6.

It should be appreciated by those skilled in the art that various modifications and variations can be made to the embodiments of the invention described or illustrated herein without departing from the scope and spirit of the invention as set forth in the appended claims.

What is claimed is:

1. An apparatus for forming meltblown material from a molten polymer, said apparatus comprising:

a die head configured with channels through which molten polymer is extruded for forming meltblown fibers, each said channel being aligned with each other said channel in only one orthogonal direction, said die head further comprising a generally V-shaped die tip defining outlets for said channels in an apex of said die tip, each said channel terminating in one said outlet at said apex of said die tip, the diameter of said apex at each said outlet being limited to the diameter of each said respective outlet;

at least one pair of air plates disposed relative to said die tip to define air channels proximate to said die tip for directing attenuating air against the molten polymer fibers extruded from said outlets;

at least one of said air channels further comprising a first zone of convergence at a first included angle, and a second zone of convergence adjacent said die tip apex at a second included angle that is less than said first included angle, wherein said second included angle is within a range of about 10 degrees to about 20 degrees such that said air channel defines a convergence angle with respect to a longitudinal axis of said polymer channels of between about 5 degrees to about 10 degrees.

2. The apparatus as in claim 1, wherein each of said air channels comprises said first and second included angles.

3. The apparatus as in claim 2, wherein said air channels are symmetric with respect to a longitudinal axis of said channels.

4. The apparatus as in claim 2, wherein said first included angle is greater than about 30 degrees such that each said air channel defines a convergence angle with respect to a longitudinal axis of said polymer channels in said first zone of convergence of at least about 15 degrees.

5. The apparatus as in claim 2, wherein said air channels have a substantially constant cross-sectional area along said second zone of convergence.

6. The apparatus as in claim 5, wherein said air channels have a varying cross-sectional area along said first zone of convergence.

7. The apparatus as in claim 2, further comprising a step angular change between said first and second zones of convergence.

8. The apparatus as in claim 2, further comprising a gradual angular change between said first and second zones of convergence.

9. The apparatus as in claim 2, wherein said die tip comprises side walls at a first angle along said first zone of convergence, and at a second angle along said second zone of convergence.

10. The apparatus as in claim 9, wherein said air plates are generally parallel to said side walls along said second zone of convergence.

11. The apparatus as in claim 2, further comprising a source of pressurized air supplied to said air channels at a pressure up to about 30 psig.

12. The apparatus as in claim 11, wherein said air is supplied at a pressure of about 20 psig.

13. An apparatus for forming meltblown material from a molten polymer, said apparatus comprising:

a die configured with channels through which molten polymer is extruded for forming meltblown fibers, said die further comprising a generally V-shaped die tip defining outlets for said channels in an apex of said die tip, each said channel being aligned with each other said channel in only one orthogonal direction, each said channel terminating in one said outlet at said apex of said die tip, the diameter of said apex at each said outlet being limited to the diameter of each said respective outlet;

at least one pair of air plates disposed relative to said die tip to define air channels proximate to said die tip for directing attenuating air against the molten polymer fibers extruded from said outlets;

said air channels further comprising a zone of convergence adjacent said die tip apex at an included angle that is within a range of about 10 degrees to about 20 degrees such that each said air channel defines a convergence angle with respect to a longitudinal axis of said polymer channels of between about 5 degrees to about 10 degrees.

14. The apparatus as in claim 13, wherein said air channels have a substantially constant cross-sectional area along said zone of convergence.

15. The apparatus as in claim 13, wherein said air plates are generally parallel to side walls of said die tip along said zone of convergence.

16. The apparatus as in claim 13, further comprising a source of pressurized air supplied to said air channels at a pressure of about 20 psig.

* * * * *